US007373738B2

(12) United States Patent
Cole, III

(10) Patent No.: US 7,373,738 B2
(45) Date of Patent: May 20, 2008

(54) SURFACE CONTACT MAXIMIZING SHOE, OUTSOLE AND RAND

(76) Inventor: Charles D. Cole, III, 405 W. Palm Ave., Redlands, CA (US) 92373

( * ) Notice: Subject to any disclaimer, the term of this patent is extended or adjusted under 35 U.S.C. 154(b) by 195 days.

(21) Appl. No.: 10/477,038

(22) PCT Filed: May 10, 2002

(86) PCT No.: PCT/US02/14744

§ 371 (c)(1),
(2), (4) Date: Nov. 6, 2003

(87) PCT Pub. No.: WO02/089624

PCT Pub. Date: Nov. 14, 2002

(65) Prior Publication Data

US 2004/0168349 A1 Sep. 2, 2004

Related U.S. Application Data

(60) Provisional application No. 60/290,308, filed on May 10, 2001.

(51) Int. Cl.
*A43B 13/00* (2006.01)

(52) U.S. Cl. ..... 36/25 R; 36/103; 36/104; 36/45; 36/133

(58) Field of Classification Search ..... 36/25 R, 36/45, 103, 104, 114, 128, 133, 8.3
See application file for complete search history.

(56) References Cited

U.S. PATENT DOCUMENTS

D99,255 S 4/1936 Troy
2,195,447 A * 4/1940 Cuozzo ..... 36/108
2,809,450 A * 10/1957 Stritter ..... 36/44
3,074,184 A 1/1963 Litak
3,406,469 A 10/1968 Dani
3,509,647 A * 5/1970 Tusa et al. ..... 36/104
3,936,959 A * 2/1976 Hanson et al. ..... 36/93
4,123,856 A * 11/1978 Lawson ..... 36/133
4,149,325 A * 4/1979 Pelfrey ..... 36/133
4,589,216 A * 5/1986 Fuscone ..... 36/25 R
4,899,470 A * 2/1990 Holland, III ..... 36/133
4,937,954 A 7/1990 Clement
5,507,106 A 4/1996 Fox

* cited by examiner

*Primary Examiner*—Jila M Mohandesi
(74) *Attorney, Agent, or Firm*—Khorsandi Patent Law Group, A Law Corporation; Marilyn R. Khorsandi

(57) ABSTRACT

The present invention provides for multiple portions of a shoe structure and the method of making these portions wherein one or more of the portions comprise two or more flat perimeter edges. The present invention further provides faceted lasts for making faceted shoe portions. An exemplary embodiment (FIG. 9) of a shoe having a faceted outsole, rand, and shoe upper of the present invention features five separate straight-line facets (30-34) and six angled corners (40-45). Alternative degrees of the angle formed by the intersection of the various straight-line facets, and the number of the various straight-line facets, can be varied for different types of foot structures. For example, the angle degrees and number of outsole facets may vary as between shoes for adult males and for women and children's feet. Facet (30) and facet (32) contact exemplary edge formations (4*a*, 4*b*) respectively with outsole contact areas (7*a*-1, 7*b*-1). Further, facets (30, 32) contact exemplary rock wall faces (5, 6) respectively with rand surface area (7*c*-1, 7*d*-1).

17 Claims, 9 Drawing Sheets

FIG. 2a
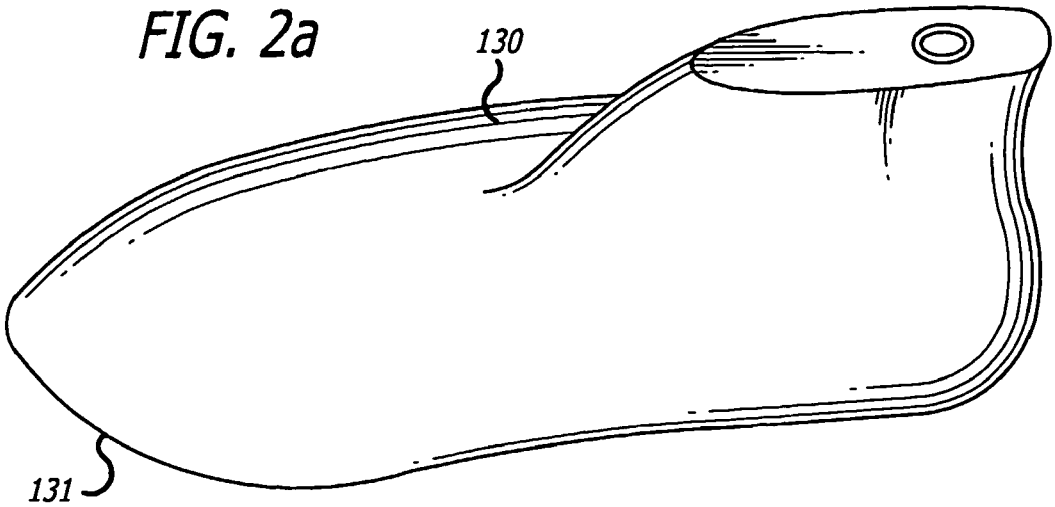
FIG. 2b
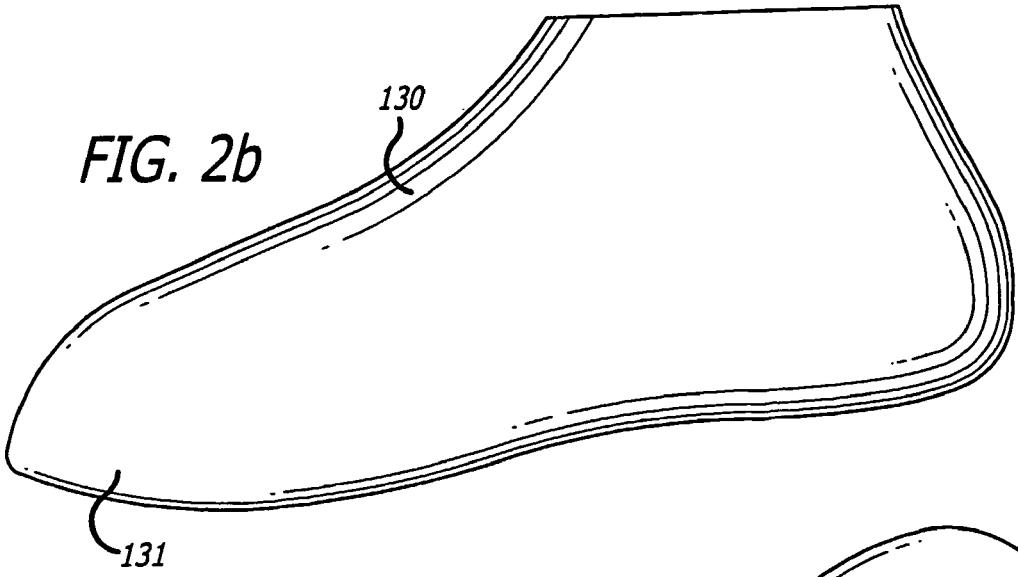
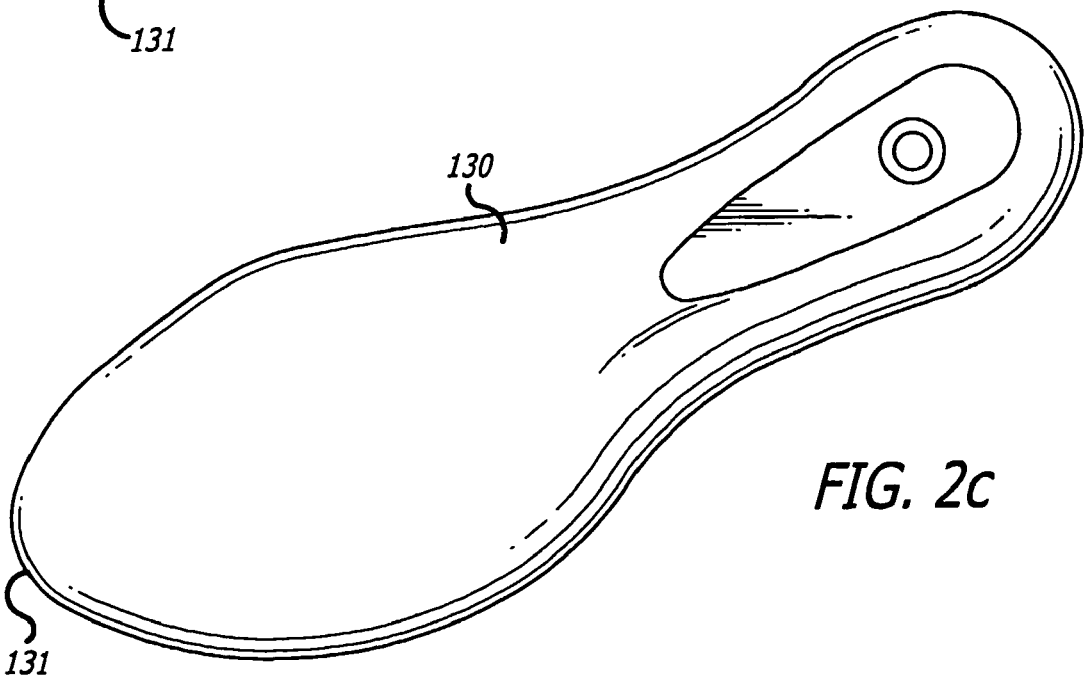
FIG. 2c

FIG. 9
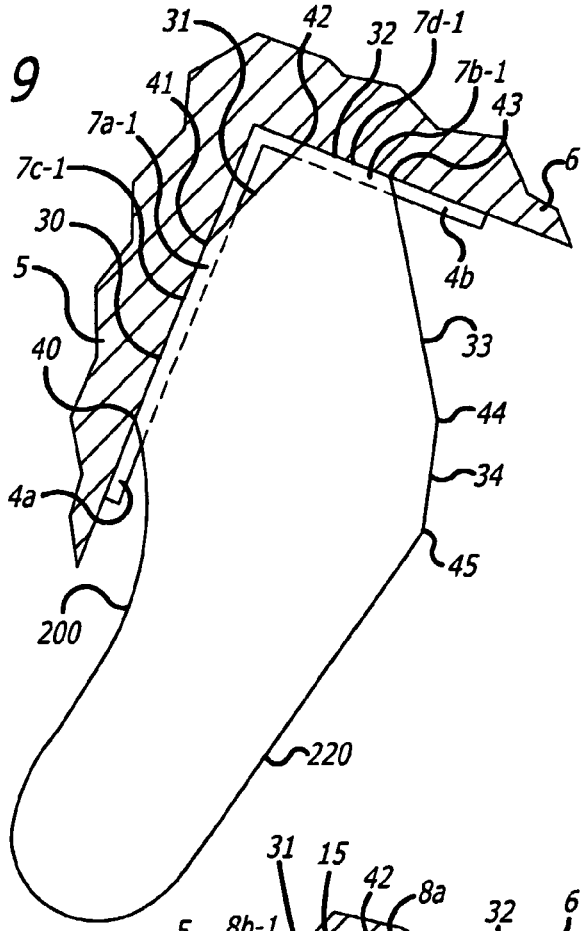
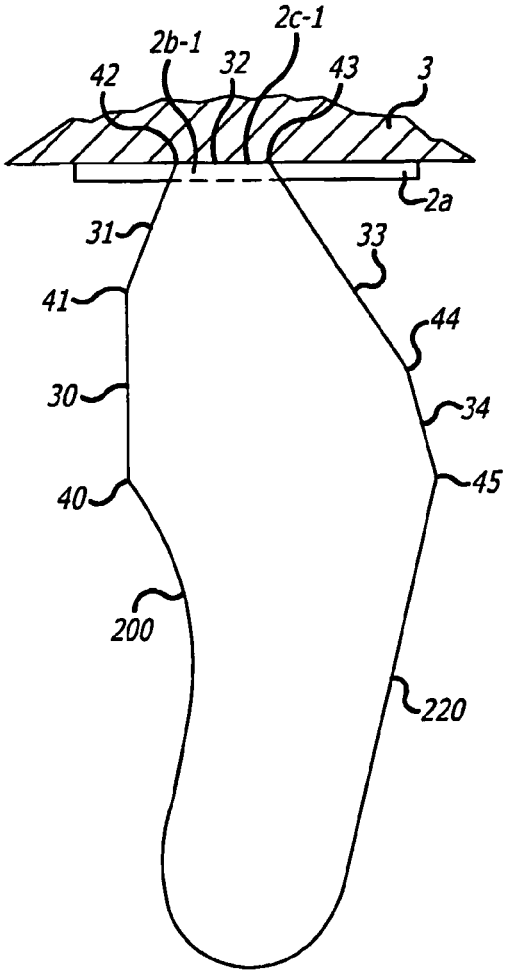
FIG. 8
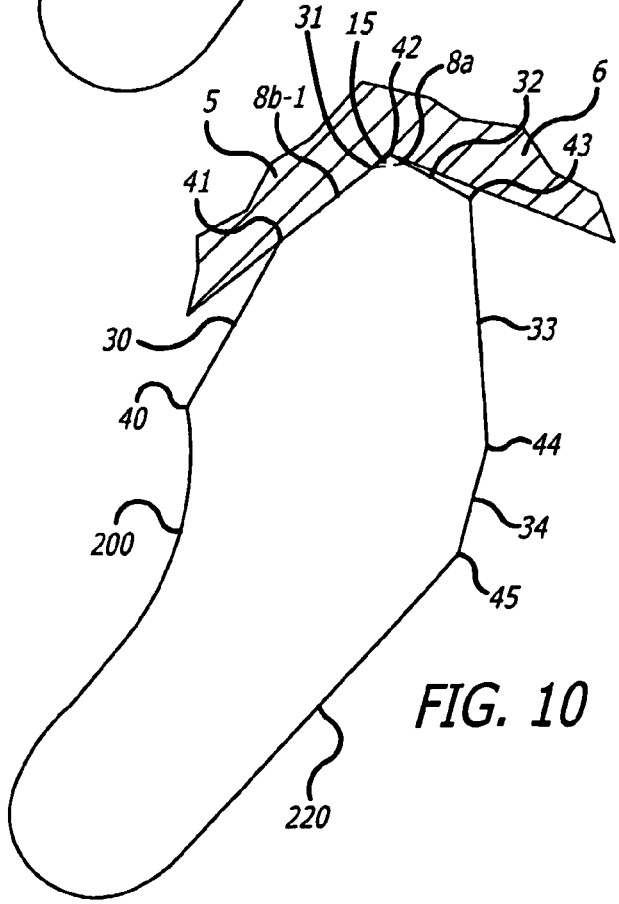
FIG. 10

SURFACE CONTACT MAXIMIZING SHOE, OUTSOLE AND RAND

CROSS REFERENCE TO RELATED APPLICATIONS

This is a U.S. National Stage Application of International Application No. PCT/US02/14744, International Filing Date May 10, 2002, which claims benefit of U.S. Provisional Patent Application, Ser. No. 60/290,308, filed May 10, 2001, Priority is claimed to U.S. Provisional Patent Application Ser. No. 60/290,308, entitled "Surface Contact Maximizing Shoe, Outsole and Rand", filed on May 10, 2001, the disclosure of which is incorporated for all purposes herein in full by reference as if stated in full herein.

FIELD OF THE INVENTION

The field of the present invention is shoes, and specifically shoes for contact with steeper than horizontal surfaces.

BACKGROUND OF THE INVENTION

Climbers, mountaineers and other sports enthusiasts often use shoes specifically designed for heightened traction, such as for "edging" on rock and steep terrain. Rock climbing (including ice-climbing), approach shoes, canyoneering, fly-fishing, river walking, and mountaineering shoes are among the types of shoes for which heightened traction can be important.

Conventional climbing shoes have outsoles and uppers, the external perimeters of which express a round, non-angular curvature. Sometimes there is a rand surrounding a portion of the lower external surface portion of the shoe upper. In the case of such conventional climbing shoes, the entire external perimeter of the outsole and the upper/rand is rounded—that is, there are no flat, or straight-lined edges. FIG. 1*a* is a bottom view of an exemplary conventional rounded-perimeter outsole 1. Although the particular outline of the footprint of a conventional climbing shoe varies in length, width and curvature according to the size of the particular shoe, such shoes leave a rounded, non-angular footprint similar to the outline of the bottom view of an exemplary conventional outsole as depicted in FIG. 1*a*.

FIGS. 1*b* and 1*c* are side and top views respectively of an exemplary conventional rounded-perimeter shoe upper 21 and rounded-perimeter shoe rand (sometimes referred to as a "foxing" on some types of shoes) 20. As is depicted in FIGS. 1*b* and 1*c*, the rand/foxing 20 is attached to a bottom portion 22 of the shoe upper 21.

Conventional climbing shoes are often made using "lasts" with rounded forefront and heels. A "last" is an object that approximates the dimensions of a human foot of a particular size and shape. A last is used in the shoemaking process as a mold around which the outer shoe is formed. That is, a particular last is used to create the shape of the inside of a shoe of a particular size and shape. Lasts are often made of nylon, aluminum, or wood. FIGS. 2*a* through 2*c* depict a three-quarter view, a side view, and a top view, respectively, of an exemplary conventional rounded-perimeter last 130. As depicted in FIGS. 2*a* through 2*c*, a conventional last 130 provides a rounded perimeter 131.

In climbing, there are drawbacks to shoes with rounded outsole perimeter curvature. When a climber encounters an edge, the climber needs to maximize the contact surface with the edge. An edge is a climbing surface, often of small dimension, that forms an angle with one or more rock walls. Exemplary edges are depicted in FIGS. 3, 4 and 5.

FIG. 3 depicts a top view of an exemplary edge formation 2*a* formed at an angle with a single rock wall 3. If a climber wearing exemplary conventional climbing shoes with a rounded-perimeter outsole 1 attempted contact with the edge formation 2*a*, then, as depicted in FIG. 3, only a small contact surface 2*b* would be formed between a small portion 2*d* of the rounded outsole 1 that contacts the edge 2*a*; the rounded upper or rand of the shoe would make contact 2*c* at only a small portion of the rounded surface of the upper or rand.

FIG. 4 depicts a top view of exemplary edge formations 4*a* and 4*b* formed along two opposing rock walls 5 and 6. If a climber wearing exemplary conventional climbing shoes with a rounded-perimeter outsole 1 attempted contact with the edge formations 4*a* and 4*b*, then, as depicted in FIG. 4, only small contact surfaces 7*a* and 7*b* would be formed between those small portions 7*e* and 7*f* respectively of the rounded outsole 1 that make contact with the edges 4*a* and 4*b* respectively; the rounded upper or rand of the shoe would make contact 7*c* and 7*d* respectively at only small portions of the rounded surface of the upper or rand.

FIG. 5 depicts a top view of an exemplary edge formation 8*a* formed between two opposing rock walls 5 and 6. FIG. 6 is a perspective view of the exemplary edge formation 8 formed between the two opposing rock walls 5 and 6. As depicted in FIG. 5, the rounded outsole 1 makes no contact with the edge 8*a*; the rounded upper or rand of the shoe would make contact 8*b* and 8*c* at only a small portion of the rounded surface of the upper or rand.

The exemplary climbing edges 2*a* (FIG. 3), 4*a*-4*b* (FIG. 4), and 8*a* (FIG. 5) are depicted as being more or less horizontal with the ground; the rock walls 3 (FIG. 3), and 5 through 6 (FIGS. 4, 5 and 6) are depicted as being more or less perpendicular with the ground. However, that is not always the case. FIGS. 7*a* and 7*b* depict side and frontal views respectively of an exemplary edge formation 9 formed between two opposing rock walls 10 and 11 where the intersection 12 of the outer faces of rock walls 10 and 11 forms an obtuse angle with horizontal ground level and where the edge 9 formed between the two rock walls is not horizontal with ground level. In such a case, the rand, or if no rand, the upper, of the shoe of a rock climber attempting to use the edge would have the opportunity to make contact with the rock walls 10 and 11. Just as is the case for a rounded outsole, a rounded rand or upper will make contact with such rock wall surfaces at only a small portion of the rounded surface of the upper or the rand (as depicted above in elements 2*c* (FIG. 3), 7*c* and 7*d* (FIG. 4) and 8*b* and 8*c* (FIG. 5). In an angled edge/wall face formation, such as the exemplary formation depicted in FIGS. 7*a* and 7*b*, greater rand contact surface would provide increased climbing traction and leverage.

In nature, there are infinite variations of edge formations. It will be understood by someone with ordinary skill in the art that the edges depicted in FIGS. 3 through 7*a*, and 7*b* are exemplary for purposes of illustration only. Even if an edge is two or three inches long, a climber wearing shoes having a curved outsole perimeter will often not be able to make contact (such as depicted in FIG. 5), or in some cases, will be able to make only minimal contact (such as depicted in FIGS. 3 and 4), with the particular target edge(s). Surface contact insufficiency is sometimes exacerbated by a tendency of a rounded shoe outsole to curl away from rock wall surfaces, e.g., 5 and 6 as depicted in FIGS. 4 and 5.

Mountain climbing, rock climbing, and similar "extreme sport" athletes perform their sports in dangerous environmental conditions, often thousands of feet above ground level. Maximizing climbing surface contact gives this type of athlete greater safety and performance.

Conventional wisdom in making and fitting rock climbing shoes in order to increase a climber's ability to make greater contact with rock climbing surfaces has been to make the shoe very, very stiff and/or to fit the shoe very, very tight. There are drawbacks to these two approaches. Stiff shoes detract from a climbers' ability to feel rock and rock edges. Tight fitting shoes are painful for the wearer.

A better way is needed to maximize outsole and rand surface contact with climbing edges and rock wall surfaces.

SUMMARY OF THE INVENTION

The present invention provides outsoles, shoes with outsoles, and methods of making shoes with outsoles, wherein the outsoles comprise two or more flat perimeter edges. The flat external perimeter outsole edges are referred to herein as outsole "facets". In the exemplary embodiments depicted and disclosed herein, these flat edge outsole facets intersect and form angled corners. In alternative embodiments, one or more of the flat outsole edges do not intersect with other flat outsole edges.

The present invention further provides rands, shoes with rands, and methods of making shoes with rands, wherein the rands comprise two or more relatively flat surfaces around the rand perimeter. The relatively flat rand surfaces are referred to herein as rand "facets". In the exemplary embodiments depicted and disclosed herein, these relatively flat rand surface facets intersect and form angled corners. In alternative embodiments, one or more of the relatively flat rand surfaces do not intersect with other flat rand surfaces.

The present invention further provides shoe uppers, shoes with uppers, and methods of making shoes with uppers, wherein the shoe uppers comprise two or more relatively flat surfaces around the shoe upper perimeter. The relatively flat shoe upper surfaces are referred to herein as shoe upper "facets". In the exemplary embodiments depicted and disclosed herein, these relatively flat shoe upper surface facets intersect and form angled corners. In alternative embodiments, one or more of the relatively flat shoe upper surfaces do not intersect with other flat shoe upper surfaces.

The present invention further provides faceted lasts for making faceted shoe uppers, faceted rands, faceted outsoles, shoes with faceted shoe uppers, shoes with faceted rands and shoes with faceted outsoles.

BRIEF DESCRIPTION OF THE DRAWINGS

These and other features of the present invention are more fully set forth in the following description of exemplary embodiments of the invention. The description is presented with reference to the accompanying drawings in which:

FIGS. 2*a* through 2*c* depict a three-quarter view, a side view, and a top view, respectively, of an exemplary conventional rounded-perimeter last;

FIGS. 8, 9 and 10 depict top views of an exemplary embodiment of the outsole facet feature of the present invention in relation to various edge formations;

DETAILED DESCRIPTION OF THE INVENTION

As further described below, in one exemplary embodiment of the invention, each shoe outsole has multiple straight-line "facets" generally aligning with the bone structure of the foot. In the exemplary embodiment, these straight-line facets intersect at sharp angles.

FIGS. 8, 9 and 10 depict top views of an exemplary embodiment of the outsole, rand, and shoe upper facet features of the present invention in relation to various edge and rock face formations. In the exemplary embodiment depicted in FIGS. 8 through 10, there are five separate straight-line facets 30-34 and six angled corners 40 through 45. Alternative degrees of the angles formed by the intersection of the various straight-line facets, and the number of the various straight-line facets, can be varied for different types of foot structures. For example, the angle degrees and number of outsole facets can be varied as between shoes for adult males and for women and children's feet.

Different types of rock form different types of formations. For example, granite often forms relatively linear straight-line edges as shown in FIGS. 8 through 10. Granite also has a tendency to form clean corners such as those depicted in FIGS. 9 and 10. Limestone on the other hand sometimes forms small round pockets (not shown), such as the size of a single finger (1-2 cm in diameter).

A faceted shoe generally increases the contact surface area with rock, greatly increasing the ability to climb. For example, angled corners can enter small limestone pockets more easily, more deeply, and more securely than a round-perimeter shoe. Further, when climbing granite formations, faceted shoes, outsoles and rands increase the contact surface areas with edge formations and rock wall faces.

Figure 1A:
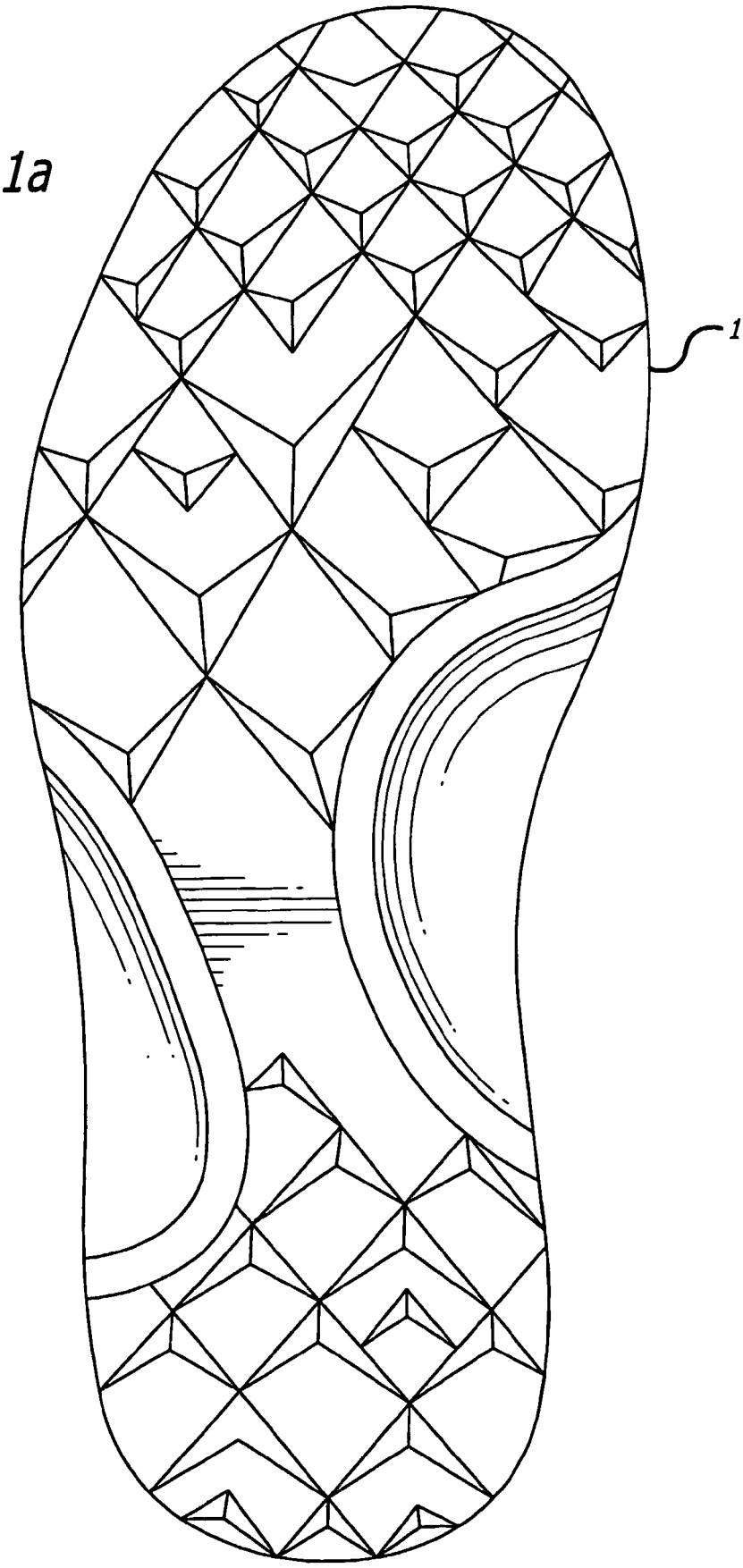
FIG. 1*a* is a bottom view of an exemplary conventional rounded-perimeter outsole.
Figure 1B:
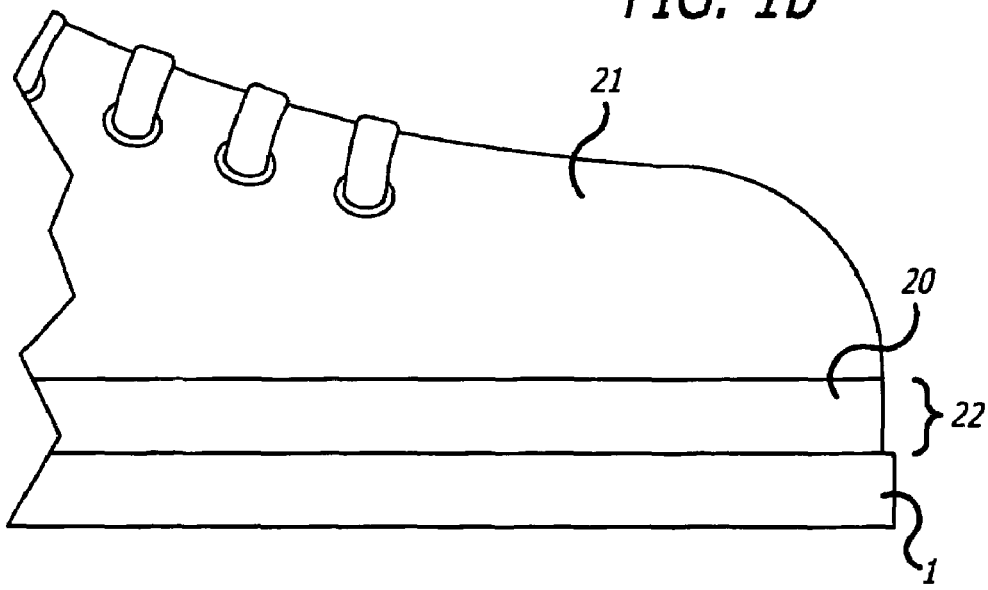
FIGS. 1*b* and 1*c* are side and top views respectively of an exemplary conventional rounded perimeter shoe upper and an exemplary rounded perimeter shoe rand.
Figure 1C:
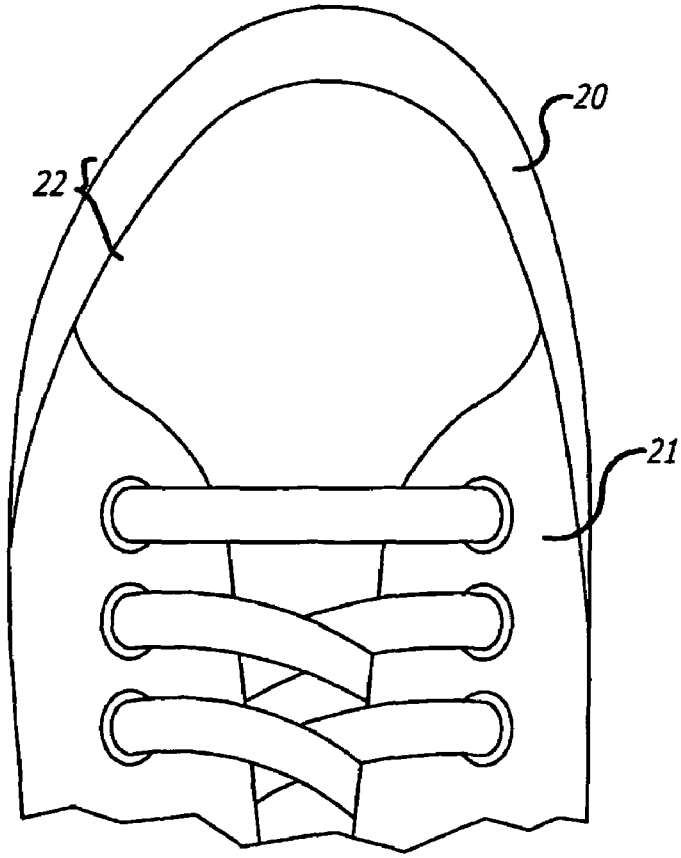
Figure 3:
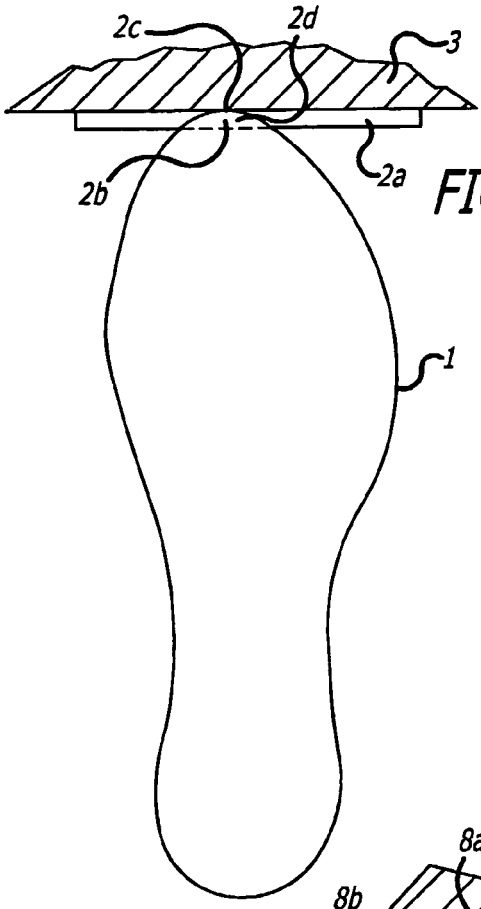
FIG. 3 depicts a top view of an exemplary edge formation formed at an angle with a single rock wall.

For example, as depicted in FIG. 8, facet 32 contacts an exemplary edge formation 2*a* with outsole contact area 2*b*-1. As depicted in FIGS. 8 and 3, the size of outsole contact area 2*b*-1 between the facet 32 and the edge formation 2*a* depicted in FIG. 8 is substantially increased as compared to the size of outsole contact area 2*b* between the rounded-perimeter outsole 1 and the edge formation 2*a* as depicted in FIG. 3. Further, as depicted in FIG. 8, facet 32 contacts an exemplary rock face 3 with rand surface area (and/or shoe upper surface area) 2*c*-1. As depicted in FIGS. 8 and 3, the size of rand surface area (and/or shoe upper surface area) 2*c*-1 contacted between the facet 32 and the rock face 3 as depicted in FIG. 8 is substantially increased as compared to the size of rock wall contact surface area 2*c* of the rounded perimeter shoe 1 as depicted in FIG. 3.

Figure 4:
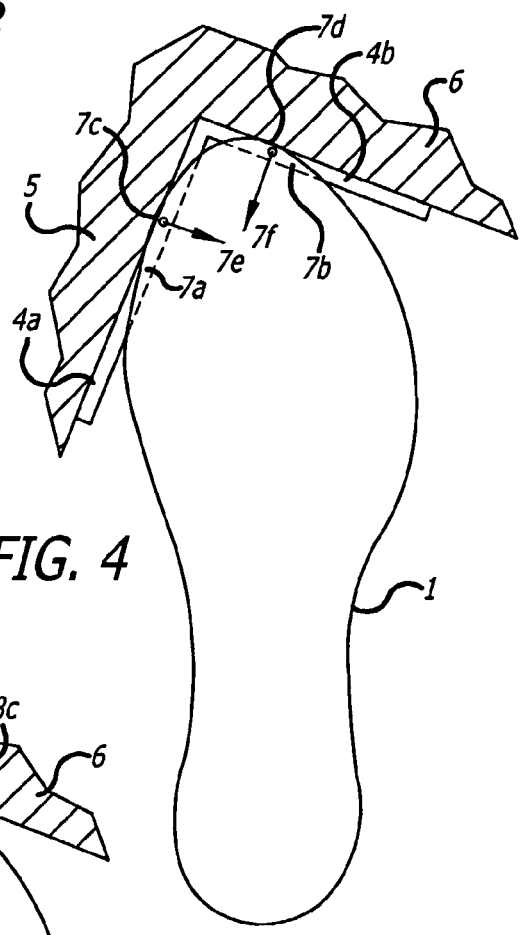
FIG. 4 depicts a top view of exemplary edge formations formed along two opposing rock walls.

As depicted in FIG. 9, facet 30 and facet 32 contact exemplary edge formations 4*a* and 4*b* respectively with outsole contact areas 7*a*-1 and 7*b*-1. As depicted in FIGS. 9 and 4, the size of outsole contact areas 7*a*-1 and 7*b*-1 between facet 30 and facet 32 and the edge formations 4*a* and 4*b* respectively depicted in FIG. 9 is substantially increased as compared to the size of outsole contact areas 7*a* and 7*b* between the rounded-perimeter outsole 1 and the edge formations 4*a* and 4*b* as depicted in FIG. 4. Further, as depicted in FIG. 9, facets 30 and 32 contact exemplary rock wall faces 5 and 6 respectively with rand surface areas (and/or shoe upper surface areas) 7*c*-1 and 7*d*-1. As depicted in FIGS. 9 and 4, the size of rand surface areas (and/or shoe upper surface areas) 7*c*-1 and 7*d*-1 contacted between facets 30 and 32 and rock wall faces 5 and 6 respectively as depicted in FIG. 9 is substantially increased as compared to the size of rock wall contact surface areas 7*c* and 7*d* between the rounded-perimeter shoe 1 and rock wall faces 5 and 6 as depicted in FIG. 4.

Figure 5:
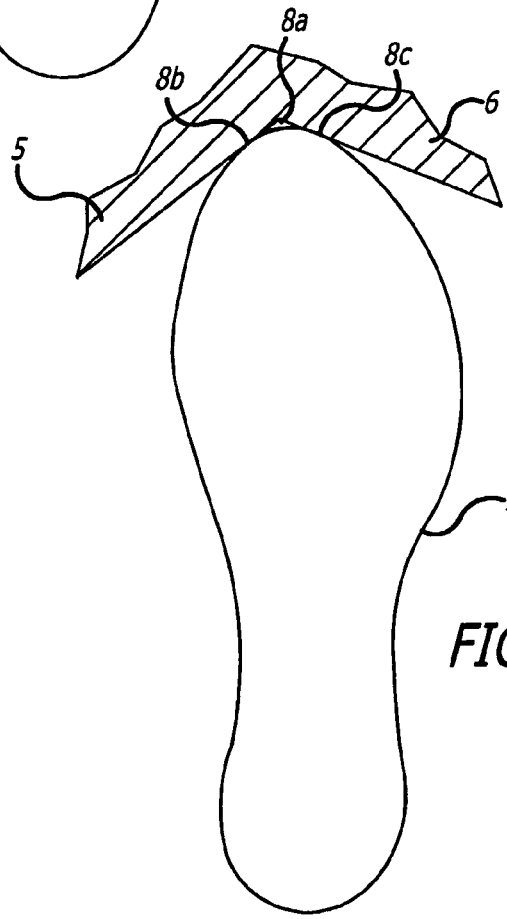
FIG. 5 depicts a top view of an exemplary edge formation formed between two opposing rock walls.
Figure 6:
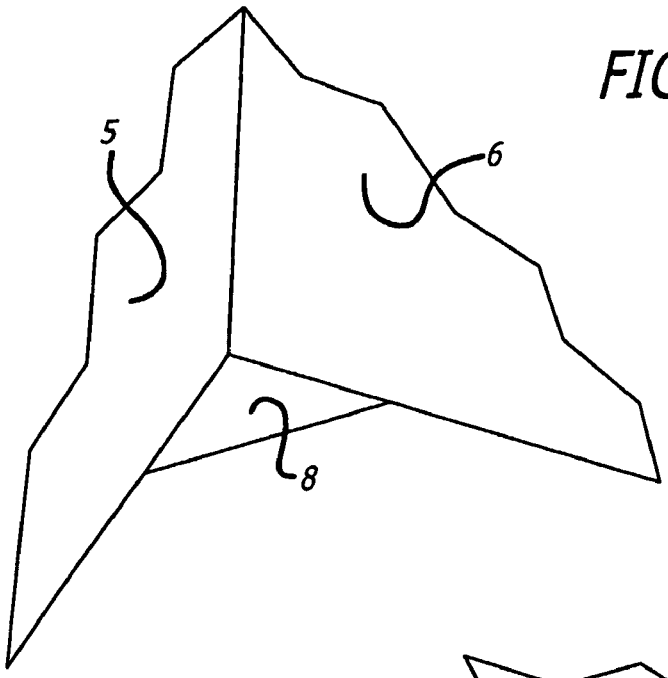
FIG. 6 is a perspective view of the exemplary edge formation depicted in FIG. 5 formed between the two opposing rock walls.
Figure 7A:
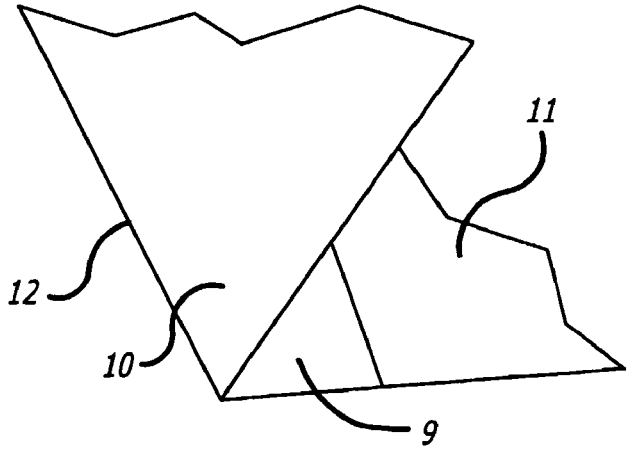
FIGS. 7*a* and 7*b* depict side and frontal views respectively of an exemplary edge formation formed between two opposing rock walls where the intersection of the outer faces of the two rock walls forms an obtuse angle with horizontal ground level.
Figure 7B:
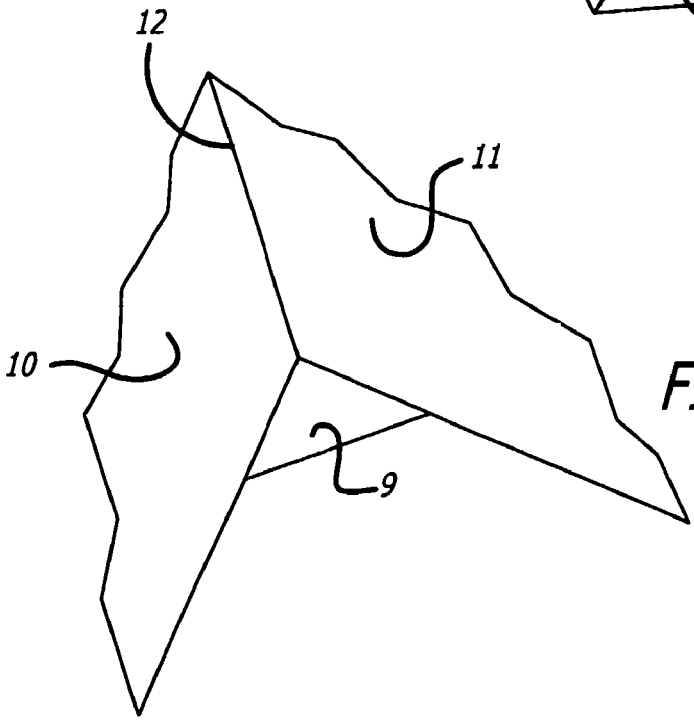

Similarly, as depicted in FIG. 10, the exemplary faceted shoe provides a corner at angle 42 formed by the intersection of facets 31 and 32 with which a contact surface area 15 can be made with exemplary edge formation 8*a*. In contrast, the rounded perimeter shoe depicted in FIG. 5 provided no contact surface area with edge formation 8*a*. In addition, it can be seen in FIG. 10, that, depending on the angles of the rock walls 5 and 6, the climber can choose to make contact surface areas with either rock wall 5 using facet 31 (contact surface area 8*b*-1), or with rock wall 6 using facet 32 (contact surface not shown).

Figure 11:
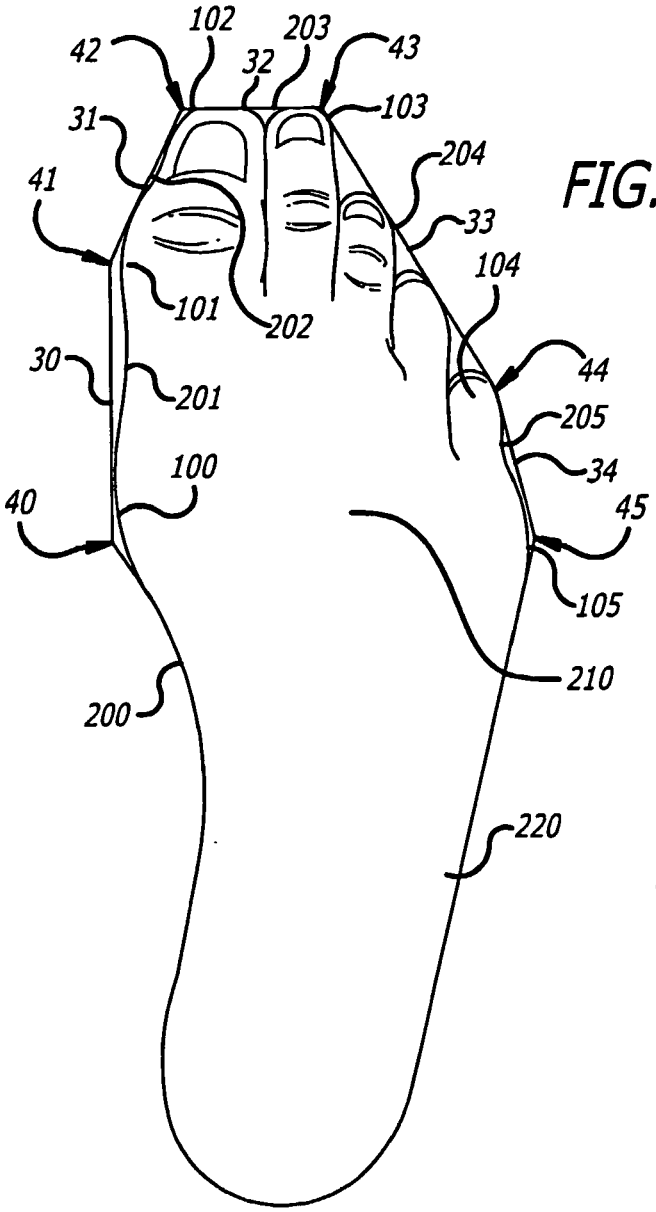
FIG. 11 is a top view showing the outline of a foot under a compression fit in a faceted shoe.

The outsole, rand and shoe upper facets and angles of the exemplary embodiment of the invention can be adjusted to fit different types of foot structures. FIG. 11 is a top view showing the outline of a foot under a compression-fit in a faceted shoe. As depicted in FIG. 11, under shoe-fitting compression, the outline of the foot, forward of the arch 200, forms a series of five roughly straight lines 201 through 205 that relate to, or form-fit within, straight-line facets 30 through 34, intersecting at six angles 40 through 45.

As will be understood by someone with ordinary skill in the art, the human foot has an arch. Reference herein to the arch of an outsole refers to the indented curvature of the outsole that mimics the arch of the human foot.

As depicted in FIG. 11 and as discussed further below, the lines 201 through 205 of a shoe-compressed foot 210 fit into the straight-lined facets, e.g., 30 through 34, of a faceted shoe upper 220. That is because the human foot is made of many small bones that have play between them and because toes curl and line up.

As depicted in FIG. 11, the straight-line facet 30 between angles 40 and 41 of the exemplary faceted shoe 220 corresponds to a roughly straight-lined area 201 of the shoe-compressed foot between the ball 100 of the foot out to the first knuckle 101 of the large toe. The straight-lined area 201 of the shoe-compressed foot 210 form-fits under shoe-fitting compression to the straight-line facet 30.

Continuing with FIG. 11, the straight-line facet 31 between angles 41 and 42 corresponds to a roughly straight-lined area 202 of the shoe-compressed foot between the knuckle 101 and an inner tip 102 of the big toe. The straight-lined area 202 of the shoe-compressed foot 210 form-fits under shoe-fitting compression to the straight-line facet 31.

The straight-line facet 32 between angles 42 and 43 relates to a roughly straight line 203 between the inner tip 102 of the big toe over to the outer tip 103 of the second toe. The straight line 203 formed by the inner tip 102 of the big toe over to the outer tip 103 of the second toe form-fits under shoe-fitting compression to the straight-line facet 32.

In the exemplary embodiment, angle 43 is provided to accommodate what is known as "Mortons toe" (a longer second toe). In an alternative embodiment, a shoe for foot structures without a Mortons toe would not include angle 43, or alternatively, angle 43 would be of greater degree.

The straight-line facet 33 between angles 43 and 44 relates to a roughly straight line 204 between the second toe outer tip 103 and the outer knuckle tip 104 of the fifth toe. The straight line 204 between the second toe outer tip 103 and the outer knuckle tip 104 of the fifth toe form-fits under shoe-fitting compression to the straight-line facet 33.

The straight-line facet 34 between angles 44 and 45 relates to a roughly straight-lined area 205 between the fifth toe outer knuckle tip 104, to the ball 105 of the pinky/fifth toe. The straight line 205 between the fifth toe outer knuckle tip 104, to the ball 105 of the pinky/fifth toe form-fits under shoe-fitting compression to the straight-line facet 34.

As depicted in FIG. 11, toes fit under compression may align with the inner shoe upper facets by curling slightly.

Figure 12:
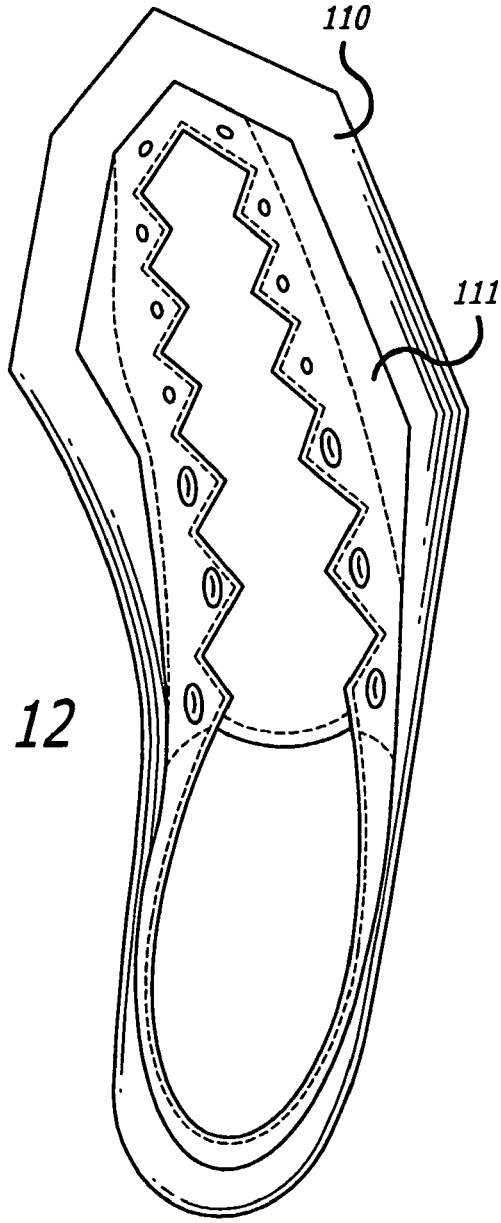
FIG. 12 is a top view of a faceted shoe having a faceted shoe upper 111, a faceted rand 110 and a faceted outsole (not shown)

FIG. 12 is a top view of a faceted shoe having a faceted shoe upper 111, a faceted rand 110 and a faceted outsole (not shown). In alternative embodiments of the invention, facets would be further provided in the heel section of the shoe upper, rand and outsole.

Figure 13A:
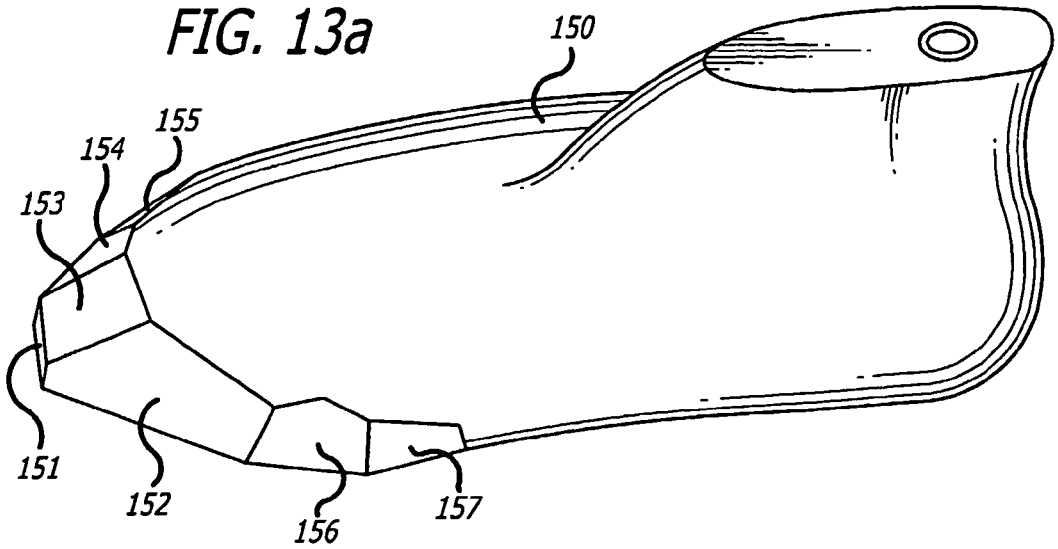
FIGS. 13*a* through 13*c* depict a perspective view, a side view and a top view respectively of a faceted last.
Figure 13B:
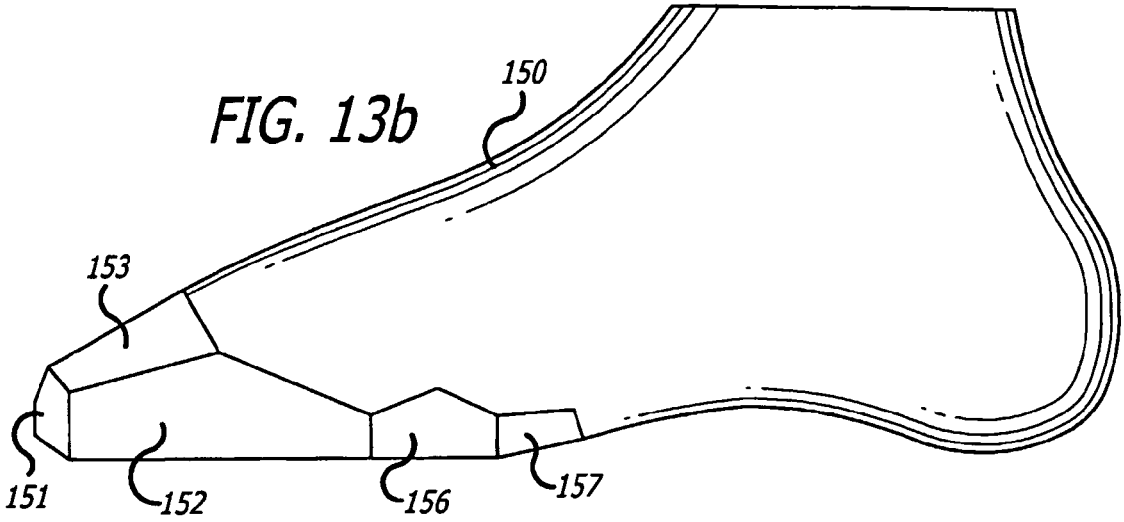
Figure 13C:
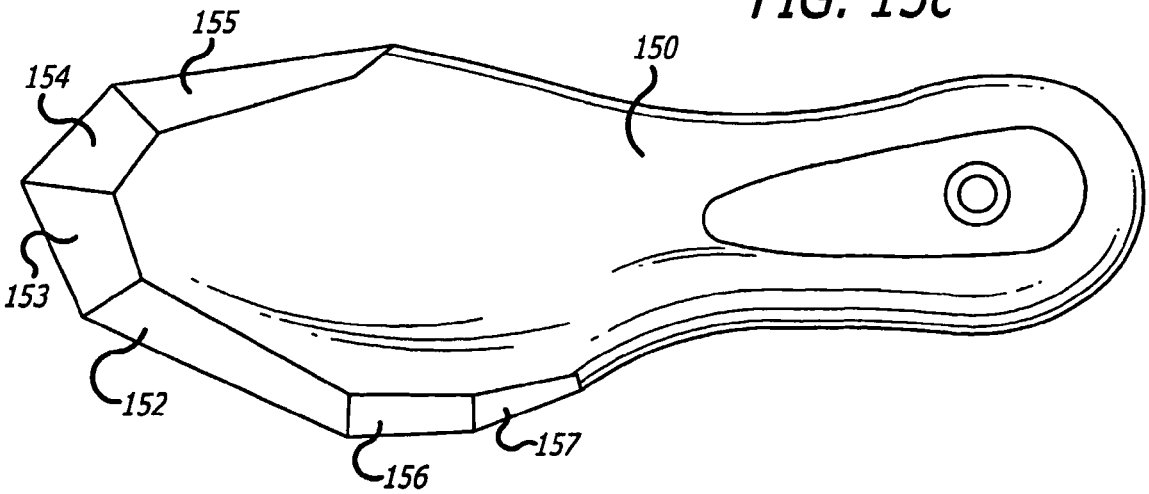

The invention provides several methods of making faceted shoes. Two of the methods use a faceted last 150 such as depicted in FIGS. 13*a* through 13*c*. FIGS. 13*a* through 13*c* depict a perspective view, a side view and a top view respectively of a faceted last 150. As depicted in FIGS. 13*a* through 13*c*, instead of a rounded perimeter 131 as with a conventional last 130 (as depicted in FIGS. 2*a* through 2*c*), a faceted last 150 provided last facets, such as 151 through 157.

As will be understood by someone with ordinary skill in the art, there are a number of ways of making shoes using a last. One method of making shoes with a last comprises grinding an outsole attached to a shoe upper that has been placed over a last. Another method of making shoes with a last comprises attaching a molded outsole to a shoe upper that has been placed over a last. Yet another method of making shoes with a last involves a process known as sock lasting, or cement lasting. The sock lasting method of making shoes comprises pulling a sewn upper over the last (like pulling a sock over a foot). Any necessary midsole is glued or otherwise attached onto the bottom of the shoe upper on the last. A rand (such as a rubber rand) can optionally be glued or otherwise attached around the lower surface perimeter of the upper.

Figure 14:
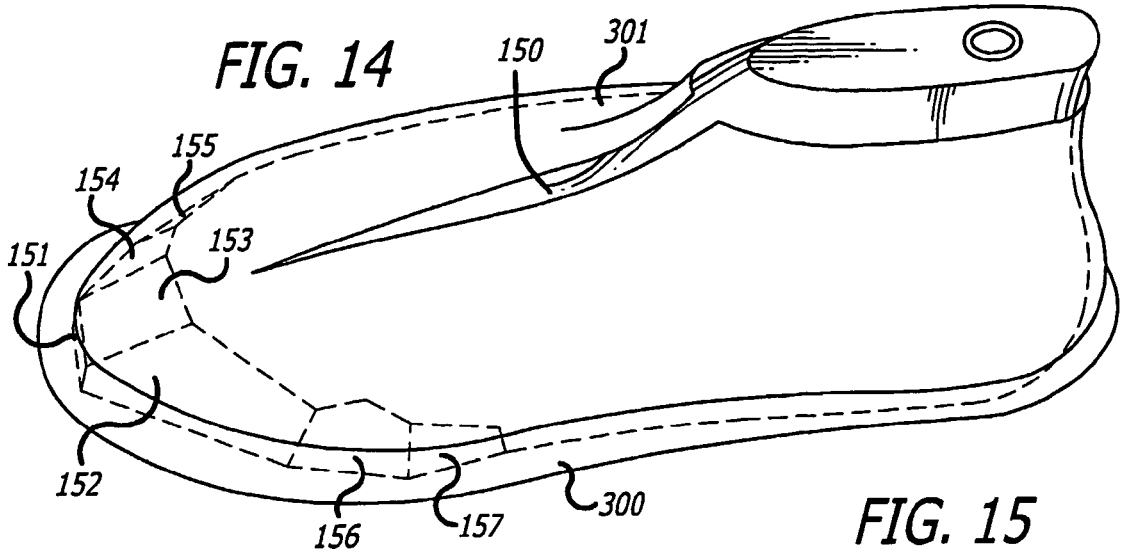
FIG. 14 is a perspective view of an exemplary unfaceted, untrimmed outsole attached to an exemplary shoe upper that has been placed over an exemplary faceted last of the present invention.

One method of making faceted shoes is depicted in FIG. 14 wherein an unfaceted, untrimmed outsole 300 would be attached to a shoe upper 301 that is placed over a faceted last 150. The outer perimeter of the outsole 300 would then be shaped by grinding the outer perimeter of the outsole 300 to conform in position and shape the facets 151, 152, 154 through 157 of the faceted last 150.

Figure 15:
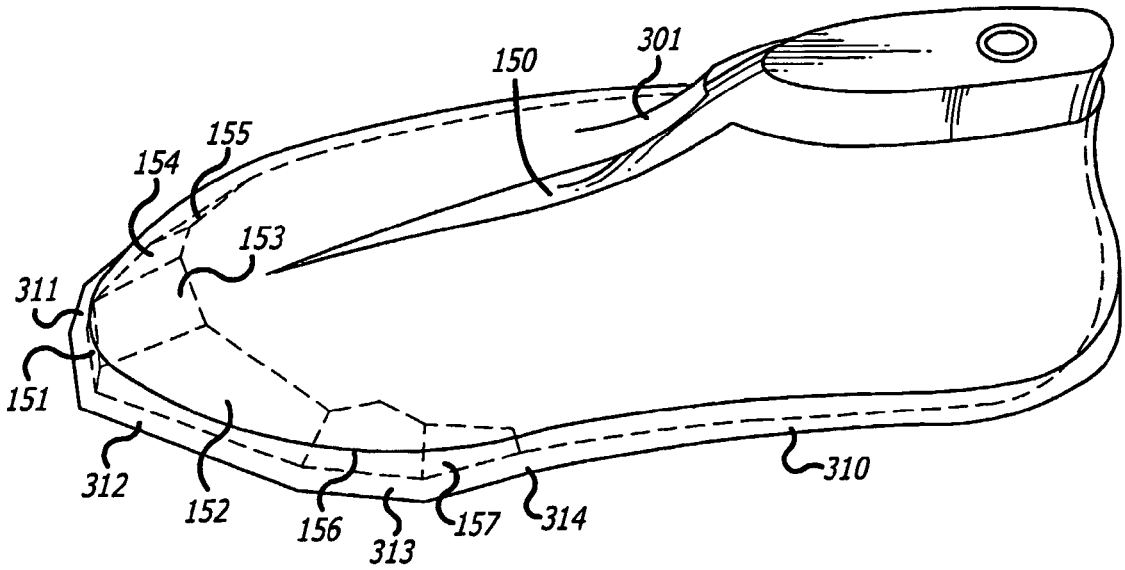
FIG. 15 is a perspective view of an exemplary molded faceted outsole attached to an exemplary shoe upper that has been placed over an exemplary faceted last of the present invention.

Another method of making faceted shoes is depicted in FIG. 15 wherein a molded faceted outsole 310 would be, attached to a shoe upper 301 that is placed over a faceted last 150. In this method, the molded faceted outsole 310 has facets, e.g., 311 through 314 shown, that conform in position and shape to the facets 151 through 157 of the faceted shape of the faceted last 150.

Figure 16:
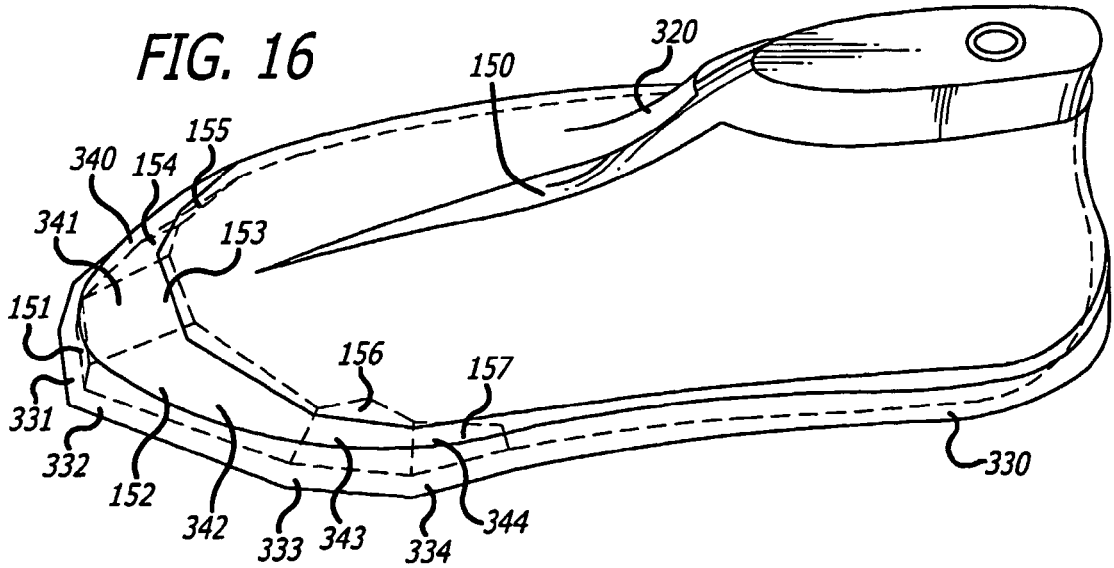
FIG. 16 is a perspective view of an exemplary faceted outsole attached to an exemplary sock shoe upper that has been slipped onto an exemplary faceted last of the present invention.

Yet another way of making a faceted shoe on a faceted last using sock lasting is depicted in FIG. 16. The sock lasting method of making shoes with faceted shoe uppers, faceted rands and/or faceted outsoles comprises pulling a sewn shoe upper 320 over the faceted last 150 (like pulling a sock over a foot). Any necessary midsole (not shown) would be glued or otherwise attached onto the bottom of the shoe upper 320 that has been slipped over the faceted last 150. A rand 340 (such as a rubber rand), such as a molded rand with facets, e.g. 341 through 344, can optionally be glued or otherwise attached around the lower surface perimeter of the shoe upper 320 such that the facets, e.g., 341 through 344 shown, conform in position and shape with the facets 151 through 157 of the faceted last 150. A faceted outsole e.g., 330, such as one having facets, e.g., 331 through 334 shown, would then be fastened, such as by gluing, to the bottom surface of the shoe sock-midsole-rand assembly. If the outsole has not been previously molded to have facets, the outsole would be trimmed to have facets, e.g., 331 through 334 shown. The trimming operation could be done for example on a sanding wheel.

In the exemplary embodiment depicted in, e.g., FIGS. 11 and 12, a molded rand with facets would be attached to the bottom of the shoe. It should be noted that the facets of a rand and/or the shoe upper, even to some extent, a molded rand, may, once the finished shoe is removed from the faceted last, express some slight curvature to the straight-lined facets. Accordingly, it will be understood by someone of ordinary skill in the art that reference herein to a relatively flat edge on the perimeter of a shoe rand and/or a shoe upper refers to a faceted edge that may express a mild degree of curvature.

Another method of making a shoe with a faceted shoe upper, faceted foxing/rand, and/or a faceted outsole would be to use a vulcanization process using a faceted last. The term "foxing" is used for a vulcanized rand. Using the vulcanization process, the upper and midsole would be placed on the faceted last. The foxing/rand would be attached to the upper and midsole and would then be baked (vulcanized) so that it takes the shape of the faceted last.

Another method of making a shoe on a faceted last would be to use a "board lasting" approach. The board lasting method comprises stapling a midsole directly to the last. An upper with no bottom would then be placed on the last and glued to the midsole, thus forming a complete upper in the shape of the last. The completion of the shoe would be similar to the above-described sock lasting method starting with the application of the rand.

It should be understood by someone with ordinary skill in the art that a faceted outsole can be sewn, glued, or otherwise attached to the bottom of a shoe with a round-perimeter shoe upper. Sometimes, stiff shoes (as with heavy duty mountaineering shoes) are made with a welted construction method. In the welted construction method, the outsole shape is not dependent upon the last shape. Using this method, an outsole having facets according to the invention would be sewn or attached to an upper of different curvature, such as a round-perimeter shoe upper. In an exemplary embodiment of this feature of the invention, the outsole would be constructed of material that is very stiff so that angles extending beyond the perimeter of the last would not flex upward when contacting edge formations. The method would be useful for plastic injection mountaineering boots for two reasons: 1.) It allows re-use of expensive round-lasted shoe upper molds; and 2.) the stiffness of a plastic injection boot allows a boot/outsole shape mismatch—that is, any shaped outsole can be attached to a stiff plastic boot.

ILLUSTRATIVE EMBODIMENTS

Although the present invention has been described in certain specific embodiments, many additional modifications and variations would be apparent to those skilled in the art. It is, therefore, to be understood that this invention may be practiced otherwise than as specifically described. Thus, the embodiments of the present invention described herein should be considered in all respects as illustrative and not restrictive, the scope of the invention to be determined by the appended claims and their equivalents rather than the foregoing description.

What is claimed is:

1. A faceted shoe, the faceted shoe comprising:

a faceted shoe upper comprising a bottom portion, a lower portion, a perimeter, a big-toe knuckle position, a big-toe inner-tip position, and a first flat faceted edge at the perimeter of the faceted shoe upper, wherein the first flat faceted edge comprises a relatively straight line between the big-toe knuckle position and the big-toe inner-tip position;

a faceted outsole attached to the bottom portion of the faceted shoe upper, said faceted outsole comprising a perimeter and a first faceted outsole edge on the perimeter of the faceted outsole, wherein the first flat faceted outsole edge of the faceted outsole corresponds in position to the first flat faceted edge of the faceted shoe upper; and a faceted rand comprising an outside perimeter, said faceted rand further comprising a first relatively flat faceted surface around the outside perimeter of the faceted rand, said faceted rand attached to the lower portion of the faceted shoe upper, wherein the first relatively flat faceted surface of the faceted rand corresponds in position to the first flat faceted edge of the faceted shoe upper.

2. The faceted shoe of claim 1, wherein the faceted shoe upper further comprises a second-toe outer-tip position, the faceted shoe further comprising:

a second flat faceted edge at the perimeter of the faceted shoe upper, wherein the second flat faceted edge comprises a relatively straight line between the big-toe inner-tip position and the second-toe outer-tip position.

3. The faceted shoe of claim 2, said faceted outsole further comprising a second faceted outsole edge on the perimeter of the faceted outsole, wherein the second flat faceted outsole edge of the faceted outsole corresponds in position to the second flat faceted edge of the faceted shoe upper.

4. The faceted shoe of claim 2, wherein the faceted rand is further molded to comprise a second relatively flat faceted side around the outside perimeter of the faceted rand, wherein the second relatively flat faceted edge of the faceted rand corresponds in position to the second flat faceted edge of the faceted shoe upper.

5. The faceted shoe of claim 1, wherein the faceted shoe upper further comprises a ball-of-a-foot position, the faceted shoe further comprising:

a third flat faceted edge at the perimeter of the faceted shoe upper, wherein the third flat faceted edge comprises a relatively straight line between the big-toe knuckle position and the ball-of-a-foot position.

6. A faceted shoe, the faceted shoe comprising:

a faceted shoe upper comprising a bottom portion, a lower portion, a shoe-upper arch, a shoe-upper big-toe inner-tip position, and a shoe-upper perimeter;

the faceted shoe upper further comprising a first flat faceted edge at the shoe-upper perimeter, wherein the first flat faceted edge comprises a relatively straight line along the shoe-upper perimeter forward of the shoe-upper arch and backward from the shoe-upper big-toe inner-tip position; and a faceted rand comprising an outside perimeter, said faceted rand further comprising a first relatively flat faceted side around the outside perimeter of the faceted rand, said faceted rand attached to the lower portion of the faceted shoe upper, wherein the first relatively flat faceted side of the faceted rand corresponds in position to the first flat faceted edge of the faceted shoe upper.

7. The faceted shoe of claim 6, the faceted shoe further comprising:

a faceted outsole attached to the bottom portion of the faceted shoe upper, said faceted outsole comprising an outsole arch, an outsole perimeter, and a first faceted outsole edge on the outsole perimeter.

8. The faceted shoe of claim 7, wherein the first flat faceted outsole edge of the faceted outsole corresponds in position to the first flat faceted edge of the faceted shoe upper.

9. A faceted shoe, the faceted shoe comprising:

a faceted shoe upper comprising a lower portion, a bottom portion, a perimeter, a second-toe outer-tip position, a fifth toe outer knuckle tip position, a fifth toe ball position, and a first flat faceted edge at the perimeter of the faceted shoe upper, wherein the first flat faceted edge comprises a relatively straight line between the second-toe outer-tip position and the fifth toe outer knuckle tip position;

a second flat faceted edge at the perimeter of the faceted shoe upper, wherein the second flat faceted edge comprises a relatively straight line between the fifth toe outer knuckle tip position and the fifth toe ball position; and a faceted rand attached to the lower portion of the faceted shoe upper, the faceted rand comprising an outside rand perimeter and further comprising a first relatively flat faceted rand surface around the outside rand perimeter, wherein the first relatively flat faceted rand surface coincides in position to the first flat faceted edge of the faceted shoe upper.

10. The faceted shoe of claim 9, the faceted shoe further comprising:

a faceted outsole attached to the bottom portion of the faceted shoe upper, said faceted outsole comprising a perimeter and a first flat faceted outsole edge on the perimeter of the faceted outsole, wherein the first flat faceted outsole edge of the faceted outsole coincides in position to the first flat faceted edge of the faceted shoe upper.

11. The faceted shoe of claim 10, said faceted outsole further comprising a second flat faceted outsole edge on the perimeter of the faceted outsole, wherein the second flat faceted outsole edge of the faceted outsole coincides in position to the second flat faceted edge of the faceted shoe upper.

12. A faceted shoe, the faceted shoe comprising:

a faceted shoe upper comprising a lower portion, a bottom portion and a shoe upper perimeter, the shoe upper perimeter comprising a second toe outer tip position and a fifth toe outer knuckle tip position, the shoe upper perimeter further comprising a first faceted shoe upper edge between the second toe outer tip position of the shoe upper perimeter and the fifth toe outer knuckle tip position of the shoe upper perimeter, the first faceted shoe upper edge comprising a substantially straight line between the second toe outer tip position of the shoe upper perimeter and the fifth toe outer knuckle tip position of the shoe upper perimeter;

a faceted outsole attached to the bottom portion of the faceted shoe upper, the faceted outsole comprising a shoe outsole perimeter, the shoe outsole perimeter comprising a second toe outer tip position and a fifth toe outer knuckle tip position, the shoe outsole perimeter further comprising a first faceted outsole edge, the first faceted outsole edge substantially coinciding in position with the first faceted shoe upper edge, the first faceted outsole edge comprising a substantially straight line between the second toe outer tip position of the shoe outsole perimeter and the fifth toe outer knuckle tip position of the shoe outsole perimeter; and a faceted rand attached to the lower portion of the faceted shoe upper, the faceted rand comprising an outside rand perimeter and further comprising a first relatively flat faceted side around the outside perimeter of the faceted rand, the first relatively flat faceted side of the faceted rand corresponding in position to the first faceted shoe upper edge.

13. The faceted shoe of claim 12, the shoe upper perimeter further comprising a fifth toe ball position, the shoe upper perimeter further comprising a second faceted shoe upper edge between the fifth toe outer knuckle tip position of the shoe upper perimeter and the fifth toe ball position of the shoe upper perimeter, the second faceted shoe upper edge comprising a substantially straight line between the fifth toe outer knuckle tip position of the shoe upper perimeter and the fifth toe ball position of the shoe upper perimeter, the shoe outsole perimeter further comprising a second faceted outsole edge, the second faceted outsole edge substantially coinciding in position with the second faceted shoe upper edge, the second faceted outsole edge comprising a substantially straight line between the fifth toe outer knuckle tip position of the shoe outsole perimeter and the fifth toe ball position of the shoe outsole perimeter.

14. A faceted shoe, the faceted shoe comprising:

a faceted shoe upper comprising a lower portion, a bottom portion, an interior compartment for enclosing a foot, and a shoe upper perimeter, the shoe upper perimeter comprising a first shoe upper perimeter position, a second shoe upper perimeter position, and a third shoe upper perimeter position, the first shoe upper perimeter position being located between a first relative perimeter position and a second relative perimeter position, the second shoe upper perimeter position being located between the second relative perimeter position and a third relative perimeter position, the third shoe upper perimeter position being located between the third relative perimeter position and a fourth relative perimeter position, the first relative perimeter position substantially coinciding in position with a inner big toe tip of a foot enclosed within the interior compartment, the second relative perimeter position substantially coinciding in position with a second toe outer tip of a foot enclosed within the interior compartment, the third relative perimeter position substantially coinciding in position with a fifth toe outer knuckle tip of a foot enclosed within the interior compartment, the fourth relative perimeter position substantially coinciding in position with a fifth toe ball of a foot enclosed within the interior compartment;

the shoe upper perimeter further comprising a first faceted shoe upper edge between the first shoe upper perimeter position and the second shoe upper perimeter position, the first faceted shoe upper edge comprising a substantially straight line between the first shoe upper perimeter position and the second shoe upper perimeter position;

the shoe upper perimeter further comprising a second faceted shoe upper edge between the second shoe upper perimeter position and the third shoe upper perimeter position, the second faceted shoe upper edge comprising a substantially straight line between the second shoe upper perimeter position and the third shoe upper perimeter position;

a faceted outsole attached to the bottom portion of the faceted shoe upper, the faceted outsole comprising a first faceted outsole edge and a second faceted outsole edge, the first faceted outsole edge substantially coinciding in position with the first faceted shoe upper edge, and the second faceted outsole edge substantially coinciding in position with the second faceted shoe upper edge; and a faceted rand fastened around the lower portion of the faceted shoe upper, the faceted rand comprising an outside rand perimeter and further comprising a first relatively flat faceted side around the outside rand perimeter, the first relatively flat faceted side around the outside rand perimeter corresponding in position to the first faceted shoe upper edge.

15. A faceted shoe, the faceted shoe comprising:

a faceted shoe upper comprising a lower portion, a bottom portion, an interior compartment for covering a foot, and a shoe upper perimeter, the shoe upper perimeter comprising a first shoe upper perimeter position, and a second shoe upper perimeter position, the first shoe upper perimeter position comprising a location along the shoe upper perimeter between a first relative perimeter position and a second relative perimeter position, the second shoe upper perimeter position comprising a location along the shoe upper perimeter between a third relative perimeter position and a fourth relative perimeter position, the first relative perimeter position substantially coinciding in position with an inner big toe tip of a foot covered within the interior compartment, the second relative perimeter position substantially coinciding in position with a second toe outer tip of a foot covered within the interior compartment, the third relative perimeter position substantially coinciding in position with a fifth toe tip of a foot covered within the interior compartment, and the fourth relative perimeter position substantially coinciding in position with a fifth toe outer knuckle of a foot covered within the interior compartment;

the shoe upper perimeter further comprising a first faceted shoe upper edge from the first shoe upper perimeter position to the second shoe upper perimeter position, the first faceted shoe upper edge comprising a substantially straight line from the first shoe upper perimeter position to the second shoe upper perimeter position;

a faceted outsole attached to the bottom portion of the faceted shoe upper, the faceted outsole comprising a first faceted outsole edge, the first faceted outsole edge substantially coinciding in position with the first faceted shoe upper edge; and a faceted rand fastened around the lower portion of the faceted shoe upper, the faceted rand comprising an outside rand perimeter and further comprising a first relatively flat faceted side around the outside rand perimeter, the first relatively flat faceted side around the outside rand perimeter corresponding in position to the first faceted shoe upper edge.

16. The faceted shoe of claim 15, the shoe upper perimeter further comprising a second faceted shoe upper edge comprising a substantially straight line from a third shoe upper perimeter position to the first shoe upper perimeter position, the third shoe upper perimeter position comprising a location substantially coinciding in position with an inner big toe tip of a foot covered within the interior compartment; and the faceted outsole further comprising a second faceted outsole edge, the second faceted outsole edge substantially coinciding in position with the second faceted shoe upper edge.

17. The faceted shoe of claim 15, the first faceted shoe upper edge positioned to cause at least a partial downward compression of at least one toe of a foot fit within the interior compartment.

* * * * *